US009731320B2

(12) United States Patent
Larson et al.

(10) Patent No.: US 9,731,320 B2
(45) Date of Patent: Aug. 15, 2017

(54) PROCESS AND SYSTEM FOR PRODUCING WATERBORNE COATING LAYER IN HIGH TEMPERATURE AND LOW HUMIDITY CLIMATE

(75) Inventors: John Charles Larson, West Chester, PA (US); John R. Moore, Lansdale, PA (US)

(73) Assignee: AXALTA COATING SYSTEMS IP CO., LLC, Wilmington, DE (US)

( * ) Notice: Subject to any disclaimer, the term of this patent is extended or adjusted under 35 U.S.C. 154(b) by 373 days.

(21) Appl. No.: 14/234,715

(22) PCT Filed: Jul. 24, 2012

(86) PCT No.: PCT/US2012/047972

§ 371 (c)(1),
(2), (4) Date: Mar. 14, 2014

(87) PCT Pub. No.: WO2013/016334

PCT Pub. Date: Jan. 31, 2013

(65) Prior Publication Data

US 2014/0199484 A1 Jul. 17, 2014

Related U.S. Application Data

(60) Provisional application No. 61/512,092, filed on Jul. 27, 2011.

(51) Int. Cl.

| | |
|---|---|
| ***B05D 3/04*** | (2006.01) |
| ***B05D 1/02*** | (2006.01) |
| ***B05B 12/12*** | (2006.01) |
| *B05D 7/14* | (2006.01) |
| *B05B 15/12* | (2006.01) |

(52) U.S. Cl.

CPC ..... *B05D 3/0486* (2013.01); *B05B 12/12* (2013.01); *B05B 15/1222* (2013.01); *B05D 1/02* (2013.01); *B05B 15/12* (2013.01); *B05D 7/14* (2013.01); *B05D 2401/20* (2013.01)

(58) Field of Classification Search

None

See application file for complete search history.

(56) References Cited

U.S. PATENT DOCUMENTS

| | | | | |
|---|---|---|---|---|
| 3,979,535 | A * | 9/1976 | Govindan | B05B 15/1222 427/377 |
| 4,367,787 | A * | 1/1983 | Bradshaw | B05B 15/1222 118/326 |
| 5,213,259 | A * | 5/1993 | Stouffer | B05B 15/1222 165/223 |
| 5,916,625 | A | 6/1999 | Rosenberger et al. | |
| 6,129,285 | A * | 10/2000 | Schafka | B05B 15/1222 165/226 |
| 2002/0096319 | A1 * | 7/2002 | Valachovic | B05B 15/1207 165/263 |
| 2008/0311836 | A1 * | 12/2008 | Bhattacharya | B05B 12/08 454/52 |

OTHER PUBLICATIONS

ISA European Patent Office, International Preliminary Report on Patentability for PCT/US2012/047972, mailed Feb. 6, 2014.

ISA European Patent Office, International Search Report and Written Opinion for PCT/US2012/047972, mailed Jan. 28, 2013.

* cited by examiner

*Primary Examiner* — Michael P Rodriguez

(74) *Attorney, Agent, or Firm* — Lorenz & Kopf, LLP

(57) ABSTRACT

The present disclosure is directed to a process for applying a waterborne coating composition in a spray booth and a system thereof. The disclosure is particularly directed to a process for introducing water into incoming air for the spray booth to produce a conditioned spray booth having appropriate humidity levels. The process of this disclosure is particularly useful for applying a waterborne coating composition having effect pigments in a low humidity and high temperature climate.

18 Claims, No Drawings

PROCESS AND SYSTEM FOR PRODUCING WATERBORNE COATING LAYER IN HIGH TEMPERATURE AND LOW HUMIDITY CLIMATE

CROSS-REFERENCE TO RELATED APPLICATIONS

This application is a U.S. National-Stage entry under 35 U.S.C. §371 based on International Application No. PCT/US2012/047972, filed Jul. 24, 2012 which was published under PCT Article 21(2) and which claims priority to U.S. Application No. 61/512,092, filed Jul. 27, 2011, which are all hereby incorporated in their entirety by reference.

TECHNICAL FIELD

The present disclosure is directed to a process for applying a waterborne coating composition over a substrate to form a coating layer. The present disclosure is particularly directed to a process for applying a waterborne coating composition having effect pigments.

BACKGROUND

Volatile organic compounds (VOCs) are commonly used in industrial products or processes, such as solvents, dispersants, carriers, coating compositions, molding compositions, cleaners, or aerosols. Volatile organic compounds (VOCs) are compounds of carbon, which can emit into atmosphere and participate in atmospheric photochemical reactions. VOCs emitted into atmosphere, such as those emitted from coating compositions during coating manufacturing, application and curing process, can be related to air pollution impacting air quality, participate in photoreactions with air to form ozone, and contribute to urban smog and global warming Efforts have been made to reduce VOC emissions into the air. Waterborne coating compositions contain less or are essentially free from VOCs and are used more and more in coatings due to their reduced environmental impacts.

Since waterborne coating compositions contain significant amounts of water, atmospheric humidity can affect the drying of wet coating layers. High humidity level in the air can cause longer drying times for a wet coating layer produced from a waterborne coating composition. Typically, the wet coating layers are exposed to elevated temperature or reduced humidity to facilitate the drying. In addition, other objects, desirable features and characteristics will become apparent from the subsequent summary and detailed description, and the appended claims, taken in conjunction with this background.

SUMMARY

This disclosure is directed to a process for applying a waterborne coating composition over a substrate to form a coating layer, said process comprising the steps of:

a) obtaining temperature and humidity level of an incoming air for a spray booth;

b) determining a water introduction rate based on the temperature and humidity level of the incoming air, an air flow rate of said incoming air, and a target range of humidity level of said spray booth;

c) producing a conditioned incoming air by introducing water into said incoming air at said air flow rate and at said water introduction rate; and d) providing said conditioned incoming air to said spray booth to produce a conditioned spray booth.

This disclosure is also directed to a process for producing predicted temperature and humidity level for a spray booth, said process comprising the steps of:

1) obtaining a target water introduction rate, an air flow rate of an incoming air for the spray booth, and temperature and humidity level of the incoming air; and 2) producing said predicted temperature and humidity level based on said target water introduction rate, said air flow rate, and said temperature and humidity level of the incoming air.

This disclosure is further directed to a system for applying a waterborne coating composition over a substrate to form a coating layer, said system comprising:

(A) a spray booth for spraying said waterborne coating composition over said substrate, said spray booth comprises one or more air inlets for introducing an incoming air into said spray booth;

(B) a water introduction device for introducing water into said incoming air; and (C) a humidity correlation function that correlates individual water introduction rates with temperatures and humidity levels of the incoming air, target ranges of humidity levels of the spray booth, and air flow rates of the incoming air;

wherein said water introduction device is configured to introduce water into said incoming air at a target water introduction rate determined based on temperature and humidity level of the incoming air, an air flow rate of said incoming air, a target range of humidity level of said spray booth, and said humidity correlation function.

DETAILED DESCRIPTION

The following detailed description is merely exemplary in nature and is not intended to limit the invention or the application and uses of the invention. Furthermore, there is no intention to be bound by any theory presented in the preceding background of the invention or the following detailed description.

The features and advantages of the present disclosure will be more readily understood, by those of ordinary skill in the art, from reading the following detailed description. It is to be appreciated that certain features of the disclosure, which are, for clarity, described above and below in the context of separate embodiments, may also be provided in combination in a single embodiment. Conversely, various features of the invention that are, for brevity, described in the context of a single embodiment, may also be provided separately or in any sub-combination. In addition, references in the singular may also include the plural (for example, "a" and "an" may refer to one, or one or more) unless the context specifically states otherwise.

The use of numerical values in the various ranges specified in this application, unless expressly indicated otherwise, are stated as approximations as though the minimum and maximum values within the stated ranges were both proceeded by the word "about." In this manner, slight variations above and below the stated ranges can be used to achieve substantially the same results as values within the ranges. Also, the disclosure of these ranges is intended as a continuous range including every value between the minimum and maximum values.

As used herein:

The term "effect pigment" or "effect pigments" refers to pigments that produce special effects in a coating. Examples of effect pigments can include, but are not limited to, light absorbing pigment, light scattering pigments, light interference pigments, and light reflecting pigments. Metallic flakes, for example aluminum flakes, can be examples of such effect pigments.

The term "gonioapparent flakes", "gonioapparent pigment" or "gonioapparent pigments" refers to pigment or pigments pertaining to change in color, appearance, or a combination thereof with change in illumination angle or viewing angle. Metallic flakes, such as aluminum flakes are examples of gonioapparent pigments. Interference pigments or pearlescent pigments can be further examples of gonioapparent pigments.

"Appearance" used herein refers to (1) the aspect of visual experience by which a coating is viewed or recognized; and (2) perception in which the spectral and geometric aspects of a coating is integrated with its illuminating and viewing environment. In general, appearance includes texture, sparkle, glitter, or other visual effects of a coating. Appearance usually varies with varying viewing angles or varying illumination angles.

The term "vehicle", "automotive", "automobile", "automotive vehicle", or "automobile vehicle" refers to an automobile such as car, van, mini van, bus, SUV (sports utility vehicle); truck; semi truck; tractor; motorcycle; trailer; ATV (all terrain vehicle); pickup truck; heavy duty mover, such as, bulldozer, mobile crane and earth mover; airplanes; boats; ships; and other modes of transport that are coated with coating compositions.

The term "coating composition" can include "two-pack coating composition", also known as 2K coating composition, referring to a coating composition having two packages that are stored in separate containers and sealed to increase the shelf life of the coating composition during storage; "one-pack coating composition", also known as 1K coating composition, referring to a coating composition having one package that is stored in one container and sealed to increase the shelf life of the coating composition during storage; a latex coating composition; or any other coating compositions know to or developed by those skilled in the art. The coating composition can be formulated to be dried or cured at certain curing conditions. Drying can be achieved by water or solvent evaporation. Examples of curing conditions can include: radiation, such as UV radiation including UV-A, UV-B, and UV-C radiations, electron beam (e-beam) radiation, infrared (IR) radiation, or lights in visible or invisible wavelengths; thermal energy, such as high temperatures; or other chemical or physical conditions.

The coating composition can comprise a "crosslinkable component" having "crosslinkable functional groups" that are functional groups positioned in the molecule of the compounds, oligomer, polymer, the backbone of the polymer, pendant from the backbone of the polymer, terminally positioned on the backbone of the polymer, or a combination thereof, wherein these functional groups are capable of crosslinking with crosslinking functional groups (during the curing step) to produce a coating in the form of crosslinked structures; and a "crosslinking component" having "crosslinking functional groups" that are functional groups positioned in the molecule of the compounds, oligomer, polymer, the backbone of the polymer, pendant from the backbone of the polymer, terminally positioned on the backbone of the polymer, or a combination thereof, wherein these functional groups are capable of crosslinking with the crosslinkable functional groups (during the curing step) to produce a coating in the form of crosslinked structures. The coating composition can further comprise one or more solvents, one or more additives, or a combination thereof.

The term "spray booth" refers to a device or a space where spray coating application can be conducted. Typically, a spray booth can comprise a space that can be enclosed. The spray booth can also comprise one or more air inlets for incoming air to enter the space and one or more air outlets for exhaust air to exit the space. A substrate, such as a vehicle or a vehicle part, can be positioned in the spray booth for applying one or more coating layers thereon. The incoming air can be filtered or otherwise cleaned to remove particles or other solid or non-solid contaminants.

A computing device used herein can refer to a data processing chip, a desktop computer, a laptop computer, a pocket PC, a personal digital assistant (PDA), a handheld electronic processing device, a smart phone that combines the functionality of a PDA and a mobile phone, or any other electronic devices that can process information automatically. A computing device can be built into other electronic devices, such as a built-in data processing chip integrated into an imaging device, color measuring device, or an appearance measuring device. A computing device can have one or more wired or wireless connections to a database, to another computing device, or a combination thereof. A computing device can be a client computer that communicates with a host computer in a multi-computer client-host system connected via a wired or wireless network including intranet and internet. A computing device can also be configured to be coupled with a data input or output device via wired or wireless connections. For example, a laptop computer can be operatively configured to receive color data and images through a wireless connection. A "portable computing device" includes a laptop computer, a pocket PC, a personal digital assistant (PDA), a handheld electronic processing device, a mobile phone, a smart phone that combines the functionality of a PDA and a mobile phone, a tablet computer, or any other electronic devices that can process information and data and can be carried by a person.

This disclosure is directed to a process for applying a waterborne coating composition over a substrate to form a coating layer. The process can comprise the steps of:

a) obtaining temperature and humidity level of an incoming air for a spray booth;

b) determining a water introduction rate based on the temperature and humidity level of the incoming air, an air flow rate of said incoming air, and a target range of humidity level of said spray booth;

c) producing a conditioned incoming air by introducing water into said incoming air at said air flow rate and at said water introduction rate; and d) providing said conditioned incoming air to said spray booth to produce a conditioned spray booth.

The process can further comprise the step of:

e) applying the waterborne coating composition over said substrate in said conditioned spray booth to produce the coating layer.

The waterborne coating composition can be applied in the conditioned spray booth to produce wet coating layer. The process can further comprise the step of drying or curing the wet coating layer to produce the coating layer. The drying or curing process can be done in the conditioned spray booth. The drying or curing process can also be done without the conditioned incoming air. The waterborne coating composition can be sprayed over the substrate in the conditioned spray booth with the conditioned incoming air, and the resulting coating layer can be dried when the spray booth is supplied with the incoming air without the water being introduced into the incoming air. This can be advantageous by providing required humidity when the coating composition is sprayed to produce a coating having desired coating appearance, and then provide the incoming air with less humidity after the coating has been sprayed to accelerate drying of the coating layer.

The incoming air can be direct ambient air from the atmosphere external to the spray booth, recycled air that has been used, conditioned air that has been modified, or a combination thereof. For example, a portion of the air that has exited a spray booth can be recycled back to the spray booth. The recycle air can be cleaned or filtered. In another example, the incoming air can first be conditioned to reduce its temperature with an air conditioning device, or to increase its temperature by a heating device.

Temperature of the incoming air can be dry bulb temperature and can be obtained from direct thermometer measurement, current local weather station temperature posting or broadcasting, weather station temperature forecast for a specific time frame, online weather condition posting, or a combination thereof. The direct thermometer measurement can be done by using a thermal measurement device, such as a thermometer, for example, a mercury thermometer, a liquid thermometer, a digital thermometer, or a combination thereof.

The humidity level of the incoming air or the spray booth can be measured using a humidity measuring device, such as a hygrometer or psychrometer. The humidity level of the incoming air can also be obtained from current local weather station posting on relative humidity or dew point, weather station forecast on relative humidity or dew point for a specific time frame, online weather condition posting, or a combination thereof.

The air flow rate of the incoming air can be measured or calculated based on dimensions and velocity of the air flow, obtained by using the spray booth manufacturer's design parameter for air flow rate through the spray booth, measuring the actual air flow rate using air flow measurement instruments, or a combination thereof. The air flow rate of the incoming air can be volumetric air flow rate, such as cubic feet per minute (CFM), or mass air flow rate, such as pounds per minute (lb/min), and can be converted to one or another.

The water introduction rate can be determined by a water rate process comprising the steps of:

b1) determining specific humidity of the incoming air based on the temperature and humidity level of the incoming air;

b2) determining a target specific humidity based on a target range of the humidity level of the spray booth;

b3) producing a specific humidity difference based on said specific humidity of the incoming air and said target specific humidity; and b4) determining said water introduction rate based on the air flow rate of the incoming air and said specific humidity difference.

The water rate process can further comprise the steps of:

b5) repeating the steps b1)-b4) to determine one or more subsequent water introduction rates based on one or more subsequent temperatures and a subsequent humidity levels of the incoming air, one or more subsequent target ranges of the humidity levels, and one or more subsequent air flow rates of the incoming air; and b6) producing a humidity correlation function correlating water introduction rates with the temperatures and humidity levels of the incoming air, target ranges of the humidity levels, and air flow rates of the incoming air.

The temperature and humidity level of the incoming air can be obtained as described above. Specific humidity of the incoming air ($H_{sp\text{-}in}$) can be derived from the temperature and relative humidity or dew point of the incoming air. The specific humidity can be the pounds of water vapor per pound of dry air. It can be expressed as "grains" of water vapor per pound of dry air, where 7000 grains=1 pound. For example, the specific humidity of the incoming air can be determined by using a psychrometric chart, wheel calculators, computer software having psychrometric functions, or a combination thereof. The specific humidity of the incoming air can also be determined by using formulas in the ASHRAE (American Society of Heating, Refrigerating and Air-Conditioning Engineers) Handbook. The specific humidity for the spray booth at the target range of humidity level can also be determined using the similarly process. Typically, a minimum specific humidity that is required for successful application of a waterborne coating can be referred to as a target specific humidity ($H_{sp\text{-}target}$) and can be expressed as water vapor per pound of dry air (grains/lb). In one example, the target specific humidity can be about 60 grains/lb.

The specific humidity difference between the incoming air and the target specific humidity can be determined by the following formula:

$$\Delta H_{sp}=H_{sp\text{-}target}-H_{sp\text{-}in} \quad \text{(Formula 1).}$$

For example, for an incoming air at 100° F. and 10% RH, the specific humidity is about 30 grains/lb according to a psychrometric chart. With the target specific humidity being 60 grains/lb, the difference $\Delta H_{sp}$ can be calculated at about 30 grains/lb. The $\Delta H_{sp}$ reflects the amount of water that needs to be introduced into the incoming air based on per pound of air.

The air flow rate of the incoming air can be obtained by using the spray booth manufacturer's design parameter for air flow rate through the spray booth, measuring the actual air flow rate using air flow measurement instruments, or a combination thereof. Examples of air flow measurement instruments can include, such as Pitot Tubes available from Dwyer Instruments, Inc., Michigan City, Ind., USA; an anemometer; or a velometer.

The volumetric air flow rate ($F_v$) can be converted to mass air flow rate ($F_w$). The common molecular weight of air is 29 (pound per mole, or lb-mole), i.e., there are 29 lbs of air per lb-mole of air. Assume the ideal gas law applies: one pound mole of air occupies 359 cubic feet. The mass air flow rate of the air in pounds per minute (lb/min) can be calculated by the formula:

$$F_w=(F_v)/359\times 29 \quad \text{(Formula 2).}$$

For example: If the volumetric air flow rate is 15,000 CFM (cubic feet per minute) then the mass air flow rate is approximately 1212 pounds per minute (lb/m):

$$15{,}000/359\times 29=1212.$$

The water introduction rate in gallons per hour ($W_{gal/hr}$) can be calculated by: first multiply the mass air flow rate by the specific humidity difference to yield the amount of water needed in grains, and then convert the grains into pounds per hour, and further convert into gal/hr. The following formulas can be used:

Water rate (grain/minute) $W_{grain/min}=F_w \times \Delta H_{sp}$ (Formula 3)

Water rate (pounds/hour) $W_{lbs/hr}=(W_{grain/min})/7000 \times 60$ (Formula 4)

Water rate (gallon/hour) $W_{gal/hr}=(W_{lbs/hr})/8.33$ (Formula 5).

For example, 30 grains per pound of specific humidity difference can be calculated into 1212×30=36,350 grains per minute ($W_{grain/min}$). Then $W_{grain/min}$ can be divided by 7000 to get the pounds of water needed to be added: 36,500/7000=5.2 pounds per minute, and times 60=312 pounds per hour ($W_{lbs/hr}$). Further, the $W_{lbs/hr}$ can be divided by 8.33 to produce the water introduction rate of 37.4 gallons per hour.

When the humidity correlation function is established as described above, the water introduction rate can also be determined based on the temperature and humidity level of the incoming air, an air flow rate of said incoming air, a target range of humidity level of said spray booth, and the humidity correlation function. The humidity correlation function can be displayed on a piece or a set of paper, a digital display device such as a monitor, a PDA, a smart phone, a wheel calculator, or any other display devices. The humidity correlation function can correlate individual water introduction rates with temperatures and humidity levels of the incoming air, target ranges of the humidity levels of the spray booth, and air flow rates of the incoming air.

The humidity correlation function can also be established by calculation, experimental measurements, or a combination thereof. In one example, the humidity correlation function can be established by setting different variables, such as varying water introduction rates, air flow rates of the incoming air, and temperatures and humidity levels of the incoming air, and measuring the resulting humidity levels in the spray booth. In another example, the humidity correlation function can be established by calculations based on the variables and space volume of the spray booth. In yet another example, the humidity correlation function can be established by a combination of measurements and calculations. In yet another example, psychrometric functions integrated into an Excel spreadsheet can be used to provide the humidity correlation function.

In step c), the water can be introduced into the incoming air using one or more water introduction devices described herein.

The amount of evaporated water can be expressed with the empirical equation:

$$g=\Theta A\,(x_s-x) \quad \text{(Formula 6)}$$

wherein:

g=amount of evaporated water (lb/h);

$\Theta$=(25+19v), evaporation coefficient (lb/ft$^2$ h);

v=velocity of air at the water surface (ft/s);

A=water surface area (ft$^2$);

$x_s$=humidity ratio in saturated air at the same temperature as the water surface (grains/lb) (grains $H_2O$ in lb Dry Air); and x=humidity ratio in the air (grains/lb) (grains $H_2O$ in lb Dry Air).

The Formula 6 shows that the variables affecting the evaporation of water can include: velocity of the air (also referred to as air flow rate of the incoming air), the surface area of the water, and the driving force for evaporation (difference between the humidity ratio of the saturated air and the humidity ratio of the incoming air). The driving force for evaporation can be in a range of from 20 to 60 grains/lb. The driving force for evaporation can be in a range of from 20 to 60 grains/lb in one example, in a range of from 20 to 50 grains/lb in another example, and in a range of from 30 to 50 grains/lb in yet another example.

The target range of humidity level of the spray booth can also include the aforementioned target range of specific humidity or the driving force for evaporation.

The water surface area (A) can be affected by the methods or apparatuses for introducing water into the incoming air stream. Examples of methods or apparatus can include, but not limited to, atomizing water into the incoming air; distributing water across one or more beds, pads, or membrane of media that the incoming air can flow through; one or more water curtains through the incoming air flow; one or more open water troughs where the incoming air can flow over; or a combination thereof.

Water can be atomized into atomized droplets producing large water surface area. Typically, the smaller the droplets size, the greater the water surface area. Examples of methods for atomizing water can include: steam, high pressure (airless) atomization, ultrasonic atomization, compressed gas atomization, spraying, combinations of ultrasonic and compressed gas, or a combination thereof. One or more atomizers can be used. One or more spraying devices can be used. In one example, the spraying device can comprise one or more nozzles. The spraying devices can be located in air ducts, air plenums, or supply inlet filter boxes of the spray booth, or a combination thereof. The amount of water evaporated can be controlled by the number of atomizers or spraying devices operating, the water/steam flow rate, or a combination thereof.

For distributing water across a bed, pad, or membrane of media, one or more porous media that can have large surface area can be used. Examples of such porous media can include nanofiber membranes. The media can be hydrophilic and should not create significant pressure drop on the incoming air stream when it passes through. The media can be oriented parallel or perpendicular or at an angle in between, to the flow of the incoming air. The amount of water evaporated can be controlled with the pumping rate of water to the media, turning one or more portions of the media on or off such as blocking one or more portions of the media, controlling portions of the media that water can flow into, or a combination thereof.

The water curtain can be formed by providing water from a water supply source to a distribution manifold and allowing the water to fall by gravity back down into the supply source. The incoming air stream can be directed through the water curtain. Water is evaporated into the incoming air. The amount of water evaporated can be controlled by the water flow rate from the supply or by controlling the size or section of the water curtain.

The open water trough can be achieved by directing the incoming air to flow over standing water in a large open shallow tank. A water pump or water supply may be needed to keep water spread throughout in the tank.

Atomizing water into the incoming air by a spraying device can be preferred. The water can be introduced by spraying into the incoming air. In one example, water can be sprayed into a passage within an air duct where the incoming air is flowing through and mixed into the incoming air. One or more humidity measuring devices such as hygrometers can be used to monitor humidity levels. One or more water control devices, such as valves, pumps, pressure devices, or a combination thereof, can be used to control or modify the water introduction rate. Water can be sprayed into the incoming air with an angle perpendicular to the flow direction of the incoming air, against the incoming air, along with the incoming air, or a combination thereof.

The velocity of air is reflected in the air flow rate of the incoming air and, in most cases, can be a design constant for a specific spray booth. With a pre-determined air flow rate for a spray booth, the velocity of air can be different at different portion or locations within the air flow system of that spray booth. For example, the velocity of air can be higher in the air ducts than in plenums and filter houses. Water can be introduced into the incoming air at a location that provides maximum air velocity. In one example, water can be introduced into the incoming air in one or more incoming air ducts of the spray booth.

The conditioned incoming air can be supplied into the spray booth. One or more controlling devices or filters can be installed to control air flow directions, air flow rates, cross sectional size or diameter of air flow passage, air flow velocity, or a combination thereof. One or more devices can be installed in the spray booth to monitor temperature, humidity level, air flow, air pressure, solvent level, or a combination thereof. In one example, the controlling devices can comprise one or more supply fans and supply fan controls, one or more exhaust fans and exhaust fan controls, one or more dampers and controllers, or a combination thereof.

The air temperature of the conditioned spray booth can be affected by energy (in terms of BTU's) required to evaporate the water that is introduced into the spray booth. This energy can come from the incoming air resulting in lowered temperature of the conditioned incoming air. The latent energy of vaporization is 1060 BTU/lb for water. In the example described above, at the water flow rate of 37.4 gallons of water per hour, about 311.5 lbs water per hour (37.4 gallons x 8.33 lb/gallon) is introduced into the spray booth. The energy required to evaporate the water is thus 330,190 BTU/hour (311.5×1060) (5504 BTU/minute). At the volumetric air flow rate of 15,000 CFM (mass air flow rate of 1212 lb/min) and the BTUs of 5504 BTU/minute, each pound of air must give up 5504/1212=4.54 BTUs of energy. The specific energy for air is 0.240 BTU/lb/° F. That can lead to a temperature reduction of 19° F. (4.54/0.240). Thus, the conditioned incoming air temperature can be reduced to 81° F. when the incoming air is at 100° F. (a 19° F. temperature reduction).

The humidity level of the conditioned spray booth can be measured using one or more humidity measuring devices. It can also be calculated based on the target specific humidity. For example, water can be added to the incoming air to achieve a target specific humidity of 60 grains per pound of dry air. Using the psychrometric chart, with the temperature of the air at 81° F. and the specific humidity at 60 grains/lb air, the % Relative Humidity of the conditioned spray booth can be at about 37% RH.

The humidity level of the incoming air and the target range of humidity level of the spray booth can be relative humidity levels. The temperature and humidity level of the incoming air can be in a range of from 80° F. to 120° F. and in a range of from 1% relative humidity (RH) to 25% RH, respectively. The conditioned spray booth can have a temperature and a humidity level in a range of from 60° F. to 100° F. and in a range of from 30% RH to 60% RH, respectively. The humidity level can be preferred in a range of from 30% RH to 50% RH.

The coating composition can be applied by spraying. The coating composition can also be applied by rolling, brushing, dipping, blade drawdown, or any other coating techniques or methods known to those skilled in the art.

The waterborne coating composition can comprise one or more metallic effect pigments. Any of the aforementioned effect pigments, gonioapparent pigment, metallic flakes, or a combination thereof, can be suitable. The substrate can have a coating layer having an existing visual coating effect produced from one or more existing metallic effect pigments, and said coating layer produced thereof can have a visual effect matching said existing visual effect. The substrate can be a vehicle, vehicle body or a vehicle part.

The waterborne coating composition can comprise in a range of from 10% to 90% of water, percentage based on the total weight of the waterborne coating composition. The waterborne coating composition can also comprise one or more organic solvents, one or more inorganic solvents, or a mixture of organic and inorganic solvents.

In hot and dry climate, such as those locations or regions having temperature over 85° F. and with humidity levels less than 15% relative humidity (RH), wet coating layers produced from a waterborne coating composition can be dried too fast leading to undesired appearances, such as edge flashing, coarse dry, or other undesired appearance due to rapid water evaporation. For waterborne coating compositions that comprise effect pigments, such as metallic flakes, such un-desired appearance can significantly impact the visual appeal or quality of the coating. The edge flashing can occur when coating on a portion of a substrate panel starts to dry while remaining portion of the same substrate panel is still being coated causing uneven appearance or edges. Coarse dry can make the coating appearing more coarse than desired and may require multiple coating overlays in order to produce a coating having desired appearance. The low humidity can also cause fast water evaporation from the droplets of the atomized waterborne coating composition during spray leading to insufficient amount of water in the coating composition when the droplets reach the substrate causing un-desired coating appearances.

One advantage of the process disclosed herein can include that waterborne coatings can be applied in a dry and hot climate and the resulting coating layers can have acceptable appearances. The process of this disclosure can also help to reduce coating overlays (spray more coating compositions over a coating area to achieve a desired coating appearance), therefore reducing coating cost and materials usage. Such advantages can be especially useful for coating compositions that comprise effect pigments, such as metallic flakes.

Another advantage of the process disclosed herein can be that there is no need to have complicated humidity measuring and controlling devices and systems. The operator can determine water introduction rate based on local weather data that are readily available from local weather forecast or weather listing.

Yet another advantage of the process disclosed herein is that the amount of water introduced into the incoming air can be controlled therefore preventing a user from introducing too much water into the incoming air than that can be evaporated.

This disclosure is also directed to a process for producing a predicted temperature and humidity level of a spray booth. The process can comprise the steps of:

1) obtaining a target water introduction rate, an air flow rate of an incoming air for the spray booth, a temperature and humidity level of the incoming air; and 2) producing said predicted temperature and humidity level of the spray booth based on said target water introduction rate, said air flow rate, and said temperature and humidity level of the incoming air.

The aforementioned water rate process can be suitable for determining the target water introduction rate.

Multiple values of predicted temperature and humidity levels can be produced at multiple target water introduction rates, multiple air flow rates of the incoming air, and multiple temperature and humidity levels of the incoming air to generate a humidity correlation function, as described above. The humidity correlation function can be suitable for predicting spray booth temperature and humidity levels at different conditions.

In one example, the process can be integrated into an Excel spreadsheet that can be executed on a computing device, and the water introduction rate can be determined based on the temperature and humidity level of the incoming air, the air flow rate of said incoming air, the target range of humidity level of said spray booth, and a humidity correlation function that correlates individual water introduction rates with temperatures and humidity levels of the incoming air, target ranges of the humidity levels of the spray booth, and air flow rates of the incoming air.

In another example, the process can be conducted in a computing device with at least one input device, such as keyboard, a digital reader, a touch screen, or a combination thereof, to enter or select input data. The computing device can have a display device to display the predicted temperature and humidity level based on the inputs. The computing device can further coupled to one or more databases that can comprise the humidity correlation function. Any of the aforementioned computing devices can be suitable.

In yet another example, the process can be conducted as a chart system or a card system. The aforementioned input data and humidity correlation function can be arranged on the charts or cards.

This disclosure is further directed to a system for applying a waterborne coating composition over a substrate to form a coating layer. The system can comprise:

(A) a spray booth for spraying said waterborne coating composition over said substrate, said spray booth comprises one or more air inlets for introducing an incoming air into said spray booth;

(B) a water introduction device for introducing water into said incoming air; and (C) a humidity correlation function that correlates individual water introduction rates with temperatures and humidity levels of the incoming air, target ranges of the humidity levels of the spray booth, and air flow rates of the incoming air;

wherein said water introduction device is configured to introduce water into said incoming air at a target water introduction rate determined based on temperature and humidity level of the incoming air, an air flow rate of said incoming air, a target range of humidity level of said spray booth, and said humidity correlation function.

The water introduction device can be turned on and off either automatically based on humidity levels of the incoming air, or manually by an operator.

The water introduction device can comprise one or more water spraying devices, one or more porous media, one or more water curtains, one or more open water troughs, or a combination thereof. The water introduction device can comprise one or more one or more spray heads or nozzles. The water introduction device can comprise one or more pumps, regulators, water pressure measuring devices, valves, pipes, hoses, or a combination thereof.

The humidity correlation function can be obtained use any of the aforementioned methods. The humidity correlation function can be produced in the forms of charts, cards, wheel calculators, computer readable program products, or a combination thereof. In one example, the humidity correlation function is a set of printed charts. In another example the humidity correlation function is an Excel spreadsheet that can display the humidity correlation on a display device of a computing device.

The system can further comprise one or more first thermal measurement devices for obtaining the temperature of the incoming air, one or more first humidity measuring devices for obtaining the humidity level of the incoming air, or a combination thereof. The system can further comprise one or more second thermal measurement devices for measuring temperature of air within the spray booth, one or more second humidity measuring devices for measuring humidity level of air within the spray booth, or a combination thereof. Typical temperature measuring devices and humidity measuring devices including any of the aforementioned devices can be suitable.

The system can further comprise a computing device functionally coupled to one or more devices selected from said first and said second humidity measuring devices, said water introduction device, or a combination thereof. The computing device can be functionally coupled to one or more of the aforementioned devices via wired or wireless connections. The computing device can be used to modify the water introduction rate based on the humidity level of the air within said spray booth, based on temperature and humidity level of the incoming air, or a combination thereof. The computing device can be used to modify the water introduction rate based on the humidity correlation function.

The computer can also record data related to temperature and humidity levels of the incoming air, the air flow rates of the incoming air, the humidity level and temperature of the air in the spray booth. The data can be stored in a data storage device, such as hard drive or a memory device of the computing device or an external data storage device, such as a hard drive or memory device that can be functionally coupled to the computing device.

The temperature and said humidity level of the incoming air can be obtained from a data provider, such as a local weather station, local weather forecast listing, newspaper, online weather date listing, or a combination thereof.

EXAMPLES

The present disclosure is further defined in the following Examples. It should be understood that these Examples, while indicating preferred embodiments of the disclosure, are given by way of illustration only. From the above discussion and these Examples, one skilled in the art can ascertain the essential characteristics of this disclosure, and without departing from the spirit and scope thereof, can make various changes and modifications of the disclosure to adapt it to various uses and conditions.

Example 1

A humidity correlation function was established as following: water was introduced into a duct for incoming air by spraying at the water introduction rate and air flow rate according to Table 1. Resulting temperatures and humidity levels of the spray booth are shown in Table 1 in pairs: Temperature/Humidity, at various ranges of temperature and humidity levels of incoming air (10% RH, 90-110° F.; 15% RH, 90-110° F.; and 20% RH, 90-110° F.).

Waterborne coating composition, Cromax® Pro, available from E.I. du Pont de Nemours and Company, Wilmington, Del., USA, was spray applied over a plurality of substrate panels at a plurality of humidity levels. Appearance of coating layers was assessed based on edge flashing, coarse dry, or a combination thereof. Humidity levels that resulted in no noticeable edge flashing or coarse dry were determined to be suitable humidity levels and indicated in foot note 1 of Table 1. When humidity was too low, some noticeable defects, such as edge flashing, coarse drying, or a combination thereof, can be observed. When humidity was too high, drying time can be prolonged.

TABLE 1

Humidity correlation table.

| Water Rate Gallons per Hour | Air Flow Rate CFM | 10% RH 90° F. | 10% RH 100° F. | 10% RH 110° F. | 15% RH 90° F. | 15% RH 100° F. | 15% RH 110° F. | 20% RH 90° F. | 20% RH 100° F. | 20% RH 110° F. |
|---|---|---|---|---|---|---|---|---|---|---|
| 20 | 10000 | 76/33[1] | 86/28[2] | 96/24[2] | 76/41[1] | 86/36[1] | 96/32[1] | 76/49[1] | 86/43[1] | 96/39[1] |
| | 12000 | 78/28[2] | 88/24[2] | 98/21[2] | 78/35[1] | 88/31[1] | 98/28[2] | 78/42[1] | 88/38[1] | 98/35[1] |
| | 14000 | 80/25[2] | 90/22[2] | 100/19[2] | 80/32[1] | 90/28[2] | 100/26[2] | 80/38[1] | 90/35[1] | 100/33[1] |
| 30 | 10000 | 69/53[1] | 79/43[1] | 89/36[1] | 69/63[3] | 79/52[1] | 89/45[1] | 69/73[3] | 79/62[3] | 89/54[1] |
| | 12000 | 73/42[1] | 83/35[1] | 93/30[1] | 73/51[1] | 83/43[1] | 93/38[1] | 73/60[3] | 83/52[1] | 93/46[1] |
| | 14000 | 75/36[1] | 85/30[1] | 95/26[2] | 75/44[1] | 85/38[1] | 95/33[1] | 75/52[1] | 85/46[1] | 95/41[1] |
| 40 | 10000 | 62/82[3] | 72/64[3] | 82/52[1] | 62/94[3] | 72/76[3] | 82/63[3] | 62/100[3] | 72/88[3] | 82/75[3] |
| | 12000 | 67/61[3] | 77/49[1] | 87/41[1] | 67/72[3] | 77/59[1] | 87/51[1] | 67/83[3] | 77/70[3] | 87/60[3] |
| | 14000 | 70/50 | 80/41[1] | 90/34[1] | 70/59[1] | 80/50[1] | 90/43[1] | 70/69[3] | 80/59[1] | 90/52[1] |

[1]Relative humidity (% RH) was suitable.
[2]Relative humidity (% RH) was too low.
[3]Relative humidity was too high.

Example 2

Predicted temperature and humidity level for a spray booth was produced according to an example of humidity calculator shown in Table 2. A target water introduction rate (gal/hr), air flow rate of an incoming air for the spray booth (CFM), temperature (°F.) and humidity level (% RH) of the incoming air were entered into an Excel spreadsheet as input data. A psychrometric function according to Table 1 was integrated into the Excel to produce predicted temperature and humidity (Spray booth conditions, in Table 2).

TABLE 2

Humidity Calculator.

| | | |
|---|---|---|
| Select incoming Air Conditions | Temperature ° F. | 100 |
| | % RH | 10% |
| Select Spray Booth Air Flow Rate (CFM) | | 12,000 |
| Choose a Water Introduction Rate (gal/hr) | | 30 |
| Resulting Air Temperature Reduction (° F.) | | 17 |
| Predicted Spray Booth Air Conditions | Temperature ° F. | 83 |
| | % RH | 35 |

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient road map for implementing an exemplary embodiment of the invention, it being understood that various changes may be made in the function and arrangement of elements described in an exemplary embodiment without departing from the scope of the invention as set forth in the appended claims and their legal equivalents.

What is claimed is:

1. A process for applying a waterborne coating composition over a substrate to form a coating layer, said process comprising the steps of:

a) obtaining temperature and humidity level of an incoming air for a spray booth;

b) determining a water introduction rate based on the temperature and humidity level of the incoming air, an air flow rate of said incoming air, and a target range of humidity level of said spray booth, wherein the water introduction rate is determined in the absence of input relating to humidity level of air within the spray booth;

c) producing a conditioned incoming air by introducing water into said incoming air at said air flow rate and at said water introduction rate; and d) providing said conditioned incoming air to said spray booth to produce a conditioned spray booth.

2. The process of claim 1 further comprising the steps of:

e) applying said waterborne coating composition over said substrate in said conditioned spray booth to produce said coating layer.

3. The process of claim 1, wherein said water introduction rate is determined by a water rate process comprising the steps of:

b1) determining specific humidity of the incoming air based on the temperature and humidity level of the incoming air;

b2) determining a target specific humidity based on a target range of humidity level of the spray booth;

b3) producing a specific humidity difference based on said specific humidity of the incoming air and said target specific humidity; and b4) determining the water introduction rate based on the air flow rate of the incoming air and said specific humidity difference.

4. The process of claim 1, wherein said water introduction rate is determined based on the temperature and humidity level of the incoming air, the air flow rate of said incoming air, the target range of humidity level of said spray booth, and a humidity correlation function that correlates individual water introduction rates with temperatures and humidity levels of the incoming air, target ranges of the humidity levels of the spray booth, and air flow rates of the incoming air.

5. The process of claim 1, wherein said waterborne coating composition comprises one or more metallic effect pigments.

6. The process of claim 5, wherein said substrate has an existing coating layer having an existing visual coating effect produced from one or more existing metallic effect pigments, and said coating layer produced thereof having a visual effect matching said existing visual effect.

7. The process of claim 1, wherein said temperature and humidity level of said incoming air are in a range of from 80° F. to 120° F. and in a range of from 1% relative humidity (RH) to 25% RH, respectively.

8. The process of claim 1, wherein said conditioned spray booth has an air temperature and a humidity level in a range of from 60° F. to 100° F. and in a range of from 30% RH to 60% RH, respectively.

9. The process of claim 8, wherein said humidity level is in a range of from 30% RH to 50% RH.

10. The process of claim 1, wherein said waterborne coating composition comprises a range of from 10% to 90% of water, percentage based on the total weight of said waterborne coating composition.

11. The process of claim 1, wherein in step c), said water is introduced by spraying into said incoming air.

12. The process of claim 1, wherein said substrate is a vehicle, vehicle body, or a vehicle part.

13. A process for producing a predicted temperature and humidity level of a spray booth, said process comprising the steps of:

1) obtaining a target water introduction rate, an air flow rate of an incoming air for the spray booth, and temperature and humidity level of the incoming air; and
2) producing said predicted temperature and humidity level based on said target water introduction rate, said air flow rate, and said temperature and humidity level of the incoming air, wherein the predicted humidity level is produced in the absence of input relating to humidity level of air within the spray booth.

14. The process of claim 13, wherein said target water introduction rate is determined by a water rate process comprising the steps of:

b1) determining specific humidity of the incoming air based on temperature and humidity level of the incoming air;
b2) determining target specific humidity based on a target range of humidity level of the spray booth;
b3) producing a specific humidity difference based on said specific humidity of the incoming air and said target specific humidity; and
b4) determining the water introduction rate based on the air flow rate of the incoming air and said specific humidity difference.

15. The process of claim 13, wherein said water introduction rate is determined based on the temperature and humidity level of the incoming air, the air flow rate of said incoming air, the target range of humidity level of said spray booth, and a humidity correlation function that correlates individual water introduction rates with temperatures and humidity levels of the incoming air, target ranges of the humidity levels of the spray booth, and air flow rates of the incoming air.

16. The process of claim 1, wherein water is introduced into said incoming air at a location that provides maximum air velocity in the spray booth.

17. The process of claim 1, wherein the humidity level of the incoming air is obtained from current local weather station posting on relative humidity or dew point, weather station forecast on relative humidity or dew point for a specific time frame, online weather condition posting, or a combination thereof.

18. The process of claim 1, further comprising drying the coating layer in the spray booth in the absence of conditioned incoming air.

* * * * *